US008672630B2

(12) United States Patent
Suciu et al.

(10) Patent No.: US 8,672,630 B2
(45) **Date of Patent: *Mar. 18, 2014**

(54) ANNULAR TURBINE RING ROTOR

(75) Inventors: Gabriel L. Suciu, Glastonbury, CT (US); James W Norris, Lebanon, CT (US); Craig A. Nordeen, Manchester, CT (US); Brian Merry, Andover, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/350,937

(22) Filed: Jan. 16, 2012

(65) Prior Publication Data

US 2012/0121425 A1 May 17, 2012

Related U.S. Application Data

(63) Continuation of application No. 11/719,855, filed as application No. PCT/US2004/040125 on Dec. 1, 2004, now Pat. No. 8,152,469.

(51) Int. Cl.

| | |
|---|---|
| ***F01D 5/06*** | (2006.01) |
| ***F01D 5/08*** | (2006.01) |
| ***F01D 5/22*** | (2006.01) |

(52) U.S. Cl.

USPC ..... 416/97 R; 416/175; 416/203; 416/219 R; 416/220 R; 416/189; 416/192; 416/193 R; 416/193 A; 416/198 A; 60/39.162; 60/39.43; 60/268

(58) Field of Classification Search

USPC ..... 415/115–116, 143, 173.4, 173.5, 173.6, 415/915; 416/92, 95, 96 R, 96 A, 97 R, 416/189–192, 193 R, 193 A, 198 A, 175, 416/203, 219 R, 220 R, 221; 60/39.162, 60/39.43, 268

See application file for complete search history.

(56) References Cited

U.S. PATENT DOCUMENTS

| | | | | |
|---|---|---|---|---|
| 1,072,457 | A | 9/1913 | Herr | |
| 1,466,324 | A | 8/1923 | Wilkinson | |
| 1,544,318 | A | 6/1925 | Hodgkinson | |
| 2,221,685 | A | 11/1940 | Smith | |
| 2,414,410 | A | 1/1947 | Griffith | |
| 2,440,069 | A * | 4/1948 | Bloomberg | 416/193 R |
| 2,499,831 | A | 3/1950 | Palmatier | |
| 2,548,975 | A | 4/1951 | Hawthorne | |
| 2,611,241 | A | 9/1952 | Schulz | |
| 2,620,554 | A | 12/1952 | Mochel et al. | |
| 2,698,711 | A | 1/1955 | Newcomb | |
| 2,801,789 | A | 8/1957 | Moss | |

(Continued)

FOREIGN PATENT DOCUMENTS

| | | |
|---|---|---|
| DE | 767704 | 5/1953 |
| DE | 765809 | 11/1954 |

(Continued)

*Primary Examiner* — Christopher Verdier

(74) *Attorney, Agent, or Firm* — Carlson, Gaskey & Olds P.C.

(57) ABSTRACT

A fan-turbine rotor assembly includes one or more turbine ring rotors. Each turbine ring rotor is cast as a single integral annular ring. By forming the turbine as one or more rings, leakage between adjacent blade platforms is minimized which increases engine efficiency. Assembly of the turbine ring rotors to the diffuser ring includes axial installation and radial locking of each turbine ring rotor.

19 Claims, 14 Drawing Sheets

(56) References Cited

U.S. PATENT DOCUMENTS

| | | | | |
|---|---|---|---|---|
| 2,830,754 | A | 4/1958 | Stalker | |
| 2,874,926 | A | 2/1959 | Gaubatz | |
| 2,989,848 | A | 6/1961 | Paiement | |
| 3,009,630 | A | 11/1961 | Busquet | |
| 3,037,742 | A | 6/1962 | Dent et al. | |
| 3,042,349 | A | 7/1962 | Pirtle et al. | |
| 3,081,597 | A | 3/1963 | Kosin et al. | |
| 3,132,842 | A | 5/1964 | Tharp | |
| 3,204,401 | A | 9/1965 | Serriades | |
| 3,216,455 | A | 11/1965 | Cornell et al. | |
| 3,267,667 | A | 8/1966 | Erwin | |
| 3,269,120 | A | 8/1966 | Sabatiuk | |
| 3,283,509 | A | 11/1966 | Nitsch | |
| 3,286,461 | A | 11/1966 | Johnson | |
| 3,302,397 | A | 2/1967 | Davidovic | |
| 3,363,419 | A | 1/1968 | Wilde | |
| 3,404,831 | A | 10/1968 | Campbell | |
| 3,465,526 | A | 9/1969 | Emerick | |
| 3,496,725 | A | 2/1970 | Ferri et al. | |
| 3,505,819 | A | 4/1970 | Wilde | |
| 3,572,971 | A * | 3/1971 | Seiwert | 416/230 |
| 3,616,616 | A | 11/1971 | Flatt | |
| 3,684,857 | A | 8/1972 | Morley et al. | |
| 3,703,081 | A | 11/1972 | Krebs et al. | |
| 3,705,775 | A | 12/1972 | Rioux | |
| 3,720,060 | A | 3/1973 | Davies et al. | |
| 3,729,957 | A | 5/1973 | Petrie et al. | |
| 3,735,593 | A | 5/1973 | Howell | |
| 3,811,273 | A | 5/1974 | Martin | |
| 3,818,695 | A | 6/1974 | Rylewski | |
| 3,836,279 | A | 9/1974 | Lee | |
| 3,861,822 | A | 1/1975 | Wanger | |
| 3,932,813 | A | 1/1976 | Gallant | |
| 3,979,087 | A | 9/1976 | Boris et al. | |
| 4,005,575 | A | 2/1977 | Scott et al. | |
| 4,130,379 | A | 12/1978 | Partington | |
| 4,147,035 | A | 4/1979 | Moore et al. | |
| 4,251,185 | A | 2/1981 | Karstensen | |
| 4,251,987 | A | 2/1981 | Adamson | |
| 4,265,646 | A | 5/1981 | Weinstein et al. | |
| 4,271,674 | A | 6/1981 | Marshall et al. | |
| 4,298,090 | A | 11/1981 | Chapman | |
| 4,326,682 | A | 4/1982 | Nightingale | |
| 4,452,038 | A | 6/1984 | Soligny | |
| 4,463,553 | A | 8/1984 | Boudigues | |
| 4,505,640 | A | 3/1985 | Hsing et al. | |
| 4,524,980 | A | 6/1985 | Lillibridge et al. | |
| 4,561,257 | A | 12/1985 | Kwan et al. | |
| 4,563,875 | A | 1/1986 | Howald | |
| 4,631,092 | A | 12/1986 | Ruckle et al. | |
| 4,687,413 | A | 8/1987 | Prario | |
| 4,751,816 | A | 6/1988 | Perry | |
| 4,785,625 | A | 11/1988 | Stryker et al. | |
| 4,817,382 | A | 4/1989 | Rudolph et al. | |
| 4,834,614 | A | 5/1989 | Davids et al. | |
| 4,883,404 | A | 11/1989 | Sherman | |
| 4,887,424 | A | 12/1989 | Geidel et al. | |
| 4,904,160 | A | 2/1990 | Partington | |
| 4,912,927 | A | 4/1990 | Billington | |
| 4,965,994 | A | 10/1990 | Ciokajlo et al. | |
| 4,999,994 | A | 3/1991 | Rud et al. | |
| 5,010,729 | A | 4/1991 | Adamson et al. | |
| 5,012,640 | A | 5/1991 | Mirville | |
| 5,014,508 | A | 5/1991 | Lifka | |
| 5,088,742 | A | 2/1992 | Catlow | |
| 5,107,676 | A | 4/1992 | Hadaway et al. | |
| 5,157,915 | A | 10/1992 | Bart | |
| 5,182,906 | A | 2/1993 | Gilchrist et al. | |
| 5,224,339 | A | 7/1993 | Hayes | |
| 5,232,333 | A | 8/1993 | Girault | |
| 5,267,397 | A | 12/1993 | Wilcox | |
| 5,269,139 | A | 12/1993 | Klees | |
| 5,275,536 | A | 1/1994 | Stephens et al. | |
| 5,279,111 | A * | 1/1994 | Bell et al. | 415/115 |
| 5,315,821 | A | 5/1994 | Dunbar et al. | |
| 5,328,324 | A | 7/1994 | Dodd | |
| 5,443,590 | A | 8/1995 | Ciokajlo et al. | |
| 5,466,198 | A | 11/1995 | McKibbin et al. | |
| 5,497,961 | A | 3/1996 | Newton | |
| 5,501,575 | A | 3/1996 | Eldredge et al. | |
| 5,537,814 | A | 7/1996 | Nastuk et al. | |
| 5,584,660 | A | 12/1996 | Carter et al. | |
| 5,628,621 | A | 5/1997 | Toborg | |
| 5,730,584 | A * | 3/1998 | Dodd | 416/190 |
| 5,746,391 | A | 5/1998 | Rodgers et al. | |
| 5,769,317 | A | 6/1998 | Sokhey et al. | |
| 5,833,244 | A * | 11/1998 | Salt et al. | 415/115 |
| 6,004,095 | A | 12/1999 | Waitz et al. | |
| 6,095,750 | A | 8/2000 | Ross et al. | |
| 6,102,361 | A | 8/2000 | Riikonen | |
| 6,158,207 | A | 12/2000 | Polenick et al. | |
| 6,223,616 | B1 | 5/2001 | Sheridan | |
| 6,244,539 | B1 | 6/2001 | Liston et al. | |
| 6,364,805 | B1 | 4/2002 | Stegherr | |
| 6,381,948 | B1 | 5/2002 | Klingels | |
| 6,382,915 | B1 | 5/2002 | Aschermann et al. | |
| 6,384,494 | B1 | 5/2002 | Avidano et al. | |
| 6,398,488 | B1 * | 6/2002 | Solda et al. | 415/115 |
| 6,430,917 | B1 | 8/2002 | Platts | |
| 6,454,535 | B1 | 9/2002 | Goshorn et al. | |
| 6,471,474 | B1 | 10/2002 | Mielke et al. | |
| RE37,900 | E | 11/2002 | Partington | |
| 6,513,334 | B2 | 2/2003 | Varney | |
| 6,619,030 | B1 | 9/2003 | Seda et al. | |
| 6,851,264 | B2 | 2/2005 | Kirtley et al. | |
| 6,883,303 | B1 | 4/2005 | Seda | |
| 6,910,854 | B2 | 6/2005 | Joslin | |
| 7,021,042 | B2 | 4/2006 | Law | |
| 7,214,157 | B2 | 5/2007 | Flamang et al. | |
| 7,874,802 | B2 | 1/2011 | Suciu et al. | |
| 7,878,762 | B2 | 2/2011 | Suciu et al. | |
| 8,152,469 | B2 * | 4/2012 | Suciu et al. | 416/947 R |
| 2002/0190139 | A1 | 12/2002 | Morrison | |
| 2003/0031556 | A1 | 2/2003 | Mulcaire et al. | |
| 2003/0131602 | A1 | 7/2003 | Ingistov | |
| 2003/0131607 | A1 | 7/2003 | Daggett | |
| 2003/0192303 | A1 | 10/2003 | Paul | |
| 2003/0192304 | A1 | 10/2003 | Paul | |
| 2004/0025490 | A1 | 2/2004 | Paul | |
| 2004/0070211 | A1 | 4/2004 | Franchet et al. | |
| 2004/0189108 | A1 | 9/2004 | Dooley | |
| 2004/0219024 | A1 | 11/2004 | Soupizon et al. | |
| 2005/0008476 | A1 | 1/2005 | Eleftheriou | |
| 2005/0127905 | A1 | 6/2005 | Proctor et al. | |

FOREIGN PATENT DOCUMENTS

| | | |
|---|---|---|
| DE | 1301634 | 8/1969 |
| DE | 2361310 | 6/1975 |
| DE | 3333437 | 4/1985 |
| EP | 077236 | 4/1983 |
| EP | 0661413 | 7/1995 |
| FR | 1033849 | 7/1953 |
| FR | 2566835 | 1/1986 |
| GB | 766728 | 1/1957 |
| GB | 958842 | 5/1964 |
| GB | 1046272 | 10/1966 |
| GB | 1287223 | 8/1972 |
| GB | 2026102 | 1/1980 |
| JP | 10184305 | 7/1998 |
| WO | 02081883 | 10/2002 |
| WO | 2004011788 | 2/2004 |
| WO | 2004092567 | 10/2004 |
| WO | 2006059980 | 6/2006 |
| WO | 2006059990 | 6/2006 |
| WO | 2006059996 | 6/2006 |
| WO | 2006060001 | 6/2006 |
| WO | 2006060003 | 6/2006 |
| WO | 2006060005 | 6/2006 |
| WO | 2006060009 | 6/2006 |
| WO | 2006060012 | 6/2006 |
| WO | 2006059997 | 11/2006 |

* cited by examiner

ANNULAR TURBINE RING ROTOR

RELATED APPLICATIONS

This application is a continuation of U.S. application Ser. No. 11/719,855 (now issued as U.S. Pat. No. 8,152,469), filed 22 May 2007, which was a National Stage Application of PCT/US2004/040125, filed 1 Dec. 2004.

BACKGROUND

The present invention relates to a gas turbine engine, and more particularly to a tip turbine ring rotor for tip turbine engine.

An aircraft gas turbine engine of the conventional turbofan type generally includes a forward bypass fan, a compressor, a combustor, and an aft turbine all located along a common longitudinal axis. A compressor and a turbine of the engine are interconnected by a shaft. The compressor is rotatably driven to compress air entering the combustor to a relatively high pressure. This pressurized air is then mixed with fuel in a combustor and ignited to form a high energy gas stream. The gas stream flows axially aft to rotatably drive the turbine which rotatably drives the compressor through the shaft. The gas stream is also responsible for rotating the bypass fan. In some instances, there are multiple shafts or spools. In such instances, there is a separate turbine connected to a separate corresponding compressor through each shaft. In most instances, the lowest pressure turbine will drive the bypass fan.

Although highly efficient, conventional turbofan engines operate in an axial flow relationship. The axial flow relationship results in a relatively complicated elongated engine structure of considerable longitudinal length relative to the engine diameter. This elongated shape may complicate or prevent packaging of the engine into particular applications.

A recent development in gas turbine engines is the tip turbine engine. Tip turbine engines locate an axial compressor forward of a bypass fan which includes hollow fan blades that receive airflow from the axial compressor therethrough such that the hollow fan blades operate as a centrifugal compressor. Compressed core airflow from the hollow fan blades is mixed with fuel in an annular combustor and ignited to form a high energy gas stream which drives the turbine integrated onto the tips of the hollow bypass fan blades for rotation therewith as generally disclosed in U.S. Patent Application Publication Nos.: 20030192303; 20030192304; and 20040025490.

The tip turbine engine provides a thrust to weight ratio equivalent to conventional turbofan engines of the same class within a package of significantly shorter length.

The tip turbine engine utilizes a fan-turbine rotor assembly which integrates a turbine onto the outer periphery of the bypass fan. Integrating the turbine onto the tips of the hollow bypass fan blades provides an engine design challenge.

Accordingly, it is desirable to provide a turbine for a fan-turbine rotor assembly, which is readily manufactured and mountable to the outer periphery of a bypass fan.

SUMMARY

The fan-turbine rotor assembly according to the present invention includes one or more turbine ring rotors. Each turbine ring rotor is cast as a single integral annular ring defined about the engine centerline and mounted to a diffuser of the fan-turbine rotor. By forming the turbine as one or more rings, leakage between adjacent blade platforms is minimized which increases engine efficiency.

Assembly of the turbine ring rotors to the diffuser ring includes axial installation and radial locking of each turbine ring rotor. The turbine ring rotors are rotated toward a radial stop in a direction which will maintain the turbine ring rotor against the radial stop during operation of the fan-turbine rotor assembly.

The present invention therefore provides a turbine for a fan-turbine rotor assembly, which is readily manufactured and mountable to the outer periphery of a bypass fan.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION

Figure 1:
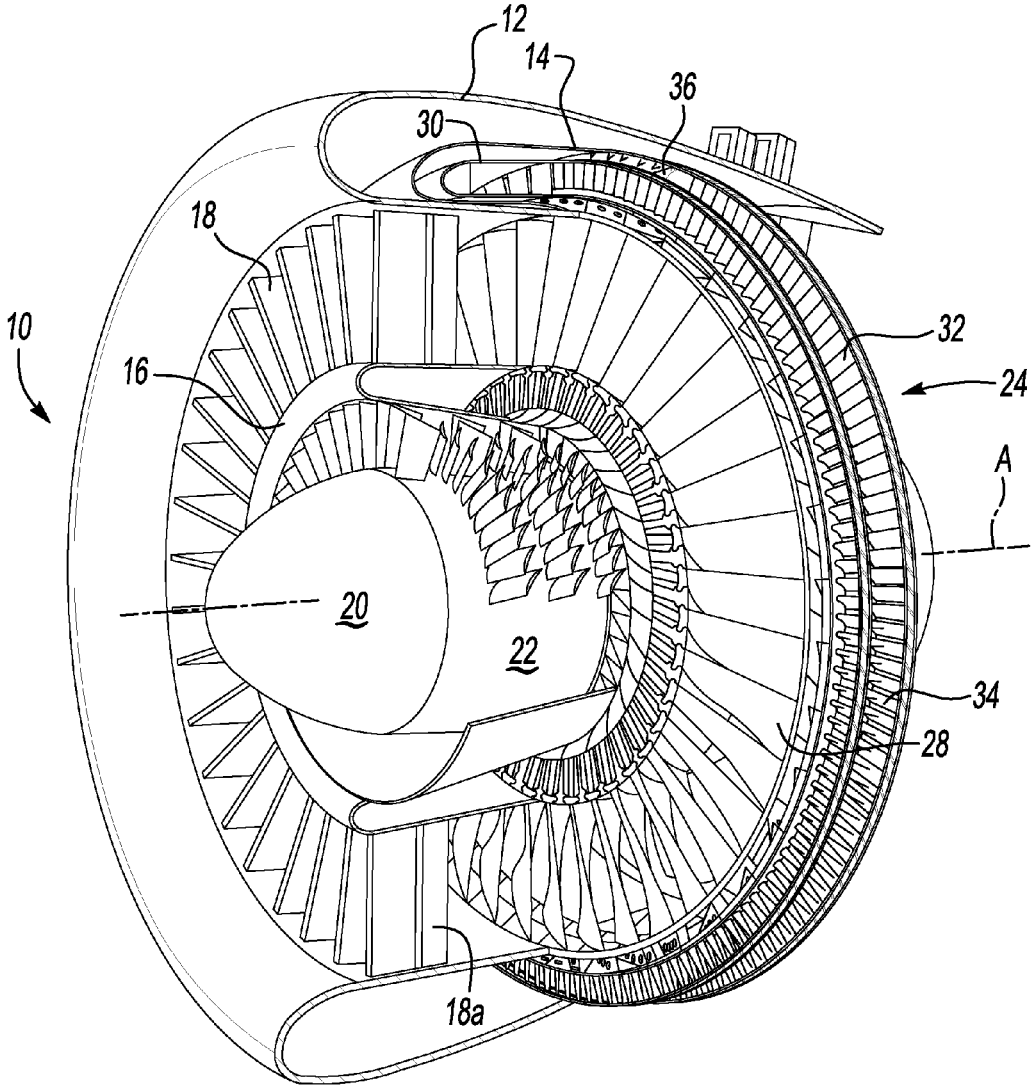
FIG. 1 is a partial sectional perspective view of a tip turbine engine.

FIG. 1 illustrates a general perspective partial sectional view of a tip turbine engine type gas turbine engine 10. The engine 10 includes an outer nacelle 12, a nonrotatable static outer support structure 14 and a nonrotatable static inner support structure 16. A multitude of fan inlet guide vanes 18 are mounted between the static outer support structure 14 and the static inner support structure 16. Each inlet guide vane preferably includes a variable trailing edge 18A.

A nose cone 20 is preferably located along the engine centerline A to smoothly direct airflow into an axial compressor 22 adjacent thereto. The axial compressor 22 is mounted about the engine centerline A behind the nose cone 20.

A fan-turbine rotor assembly 24 is mounted for rotation about the engine centerline A aft of the axial compressor 22. The fan-turbine rotor assembly 24 includes a multitude of hollow fan blades 28 to provide internal, centrifugal compression of the compressed airflow from the axial compressor 22 for distribution to an annular combustor 30 located within the nonrotatable static outer support structure 14.

A turbine 32 includes a multitude of tip turbine blades 34 (two stages shown) which rotatably drive the hollow fan blades 28 relative to a multitude of tip turbine stators 36 which extend radially inwardly from the static outer support structure 14. The annular combustor 30 is axially forward of the turbine 32 and communicates with the turbine 32.

Figure 2:
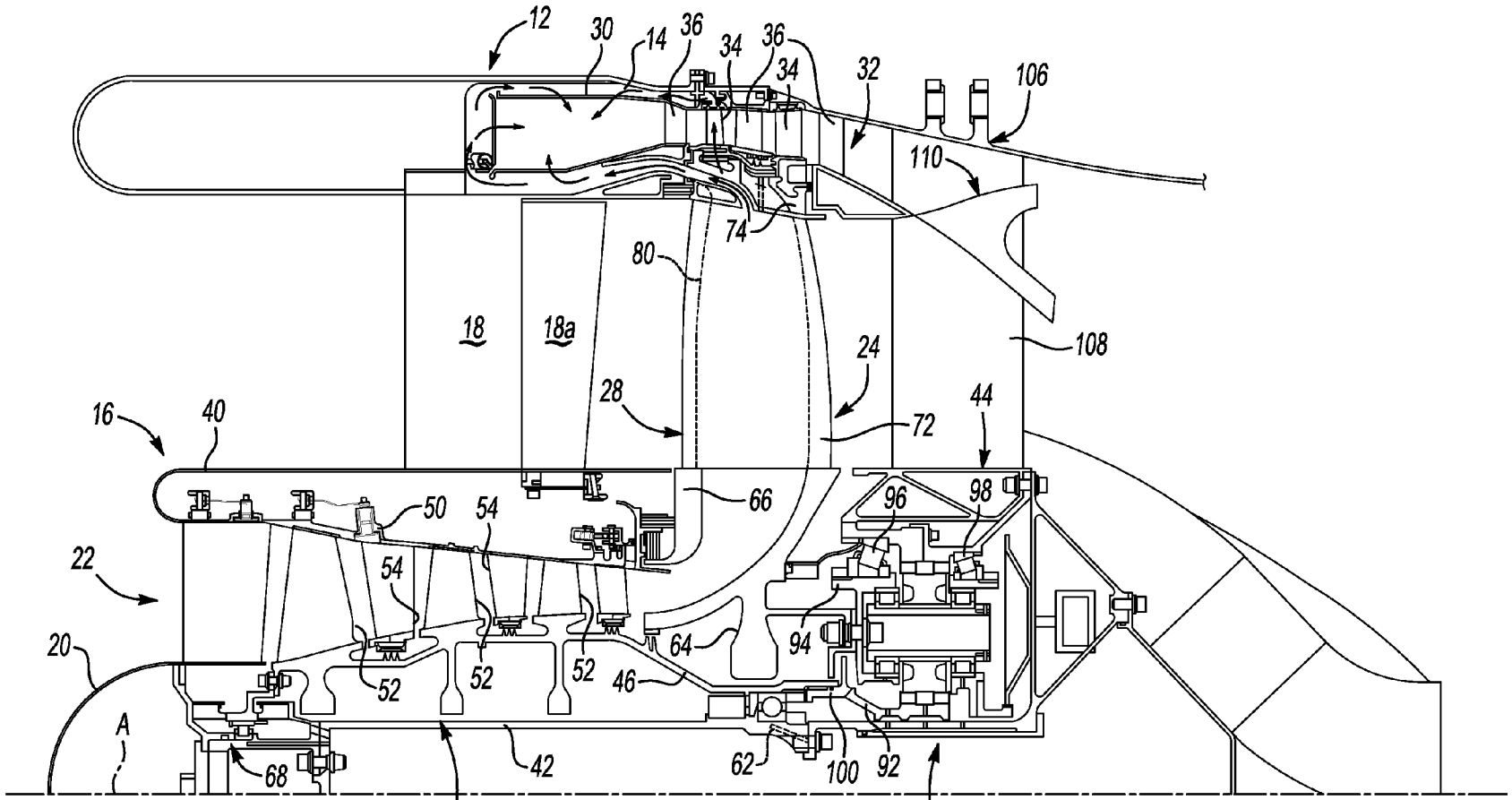
FIG. 2 is a longitudinal sectional view of a tip turbine engine along an engine centerline.

Referring to FIG. 2, the nonrotatable static inner support structure 16 includes a splitter 40, a static inner support housing 42 and a static outer support housing 44 located coaxial to said engine centerline A.

The axial compressor 22 includes the axial compressor rotor 46 from which a plurality of compressor blades 52 extend radially outwardly and a compressor case 50 fixedly mounted to the splitter 40. A plurality of compressor vanes 54 extend radially inwardly from the compressor case 50 between stages of the compressor blades 52. The compressor blades 52 and compressor vanes 54 are arranged circumferentially about the axial compressor rotor 46 in stages (three stages of compressor blades 52 and compressor vanes 54 are shown in this example). The axial compressor rotor 46 is mounted for rotation upon the static inner support housing 42 through a forward bearing assembly 68 and an aft bearing assembly 62.

The fan-turbine rotor assembly 24 includes a fan hub 64 that supports a multitude of the hollow fan blades 28. Each fan blade 28 includes an inducer section 66, a hollow fan blade section 72 and a diffuser section 74. The inducer section 66 receives airflow from the axial compressor 22 generally parallel to the engine centerline A and turns the airflow from an axial airflow direction toward a radial airflow direction. The airflow is radially communicated through a core airflow passage 80 within the fan blade section 72 where the airflow is centrifugally compressed. From the core airflow passage 80, the airflow is turned and diffused by the diffuser section 74 toward an axial airflow direction toward the annular combustor 30. Preferably the airflow is diffused axially forward in the engine 10, however, the airflow may alternatively be communicated in another direction.

A gearbox assembly 90 aft of the fan-turbine rotor assembly 24 provides a speed increase between the fan-turbine rotor assembly 24 and the axial compressor 22. Alternatively, the gearbox assembly 90 could provide a speed decrease between the fan-turbine rotor assembly 24 and the axial compressor rotor 46. The gearbox assembly 90 is mounted for rotation between the static inner support housing 42 and the static outer support housing 44. The gearbox assembly 90 includes a sun gear shaft 92 which rotates with the axial compressor 22 and a planet carrier 94 which rotates with the fan-turbine rotor assembly 24 to provide a speed differential therebetween. The gearbox assembly 90 is preferably a planetary gearbox that provides co-rotating or counter-rotating rotational engagement between the fan-turbine rotor assembly 24 and an axial compressor rotor 46. The gearbox assembly 90 is mounted for rotation between the sun gear shaft 92 and the static outer support housing 44 through a forward bearing 96 and a rear bearing 98. The forward bearing 96 and the rear bearing 98 are both tapered roller bearings and both handle radial loads. The forward bearing 96 handles the aft axial loads while the rear bearing 98 handles the forward axial loads. The sun gear shaft 92 is rotationally engaged with the axial compressor rotor 46 at a splined interconnection 100 or the like.

In operation, air enters the axial compressor 22, where it is compressed by the three stages of the compressor blades 52 and compressor vanes 54. The compressed air from the axial compressor 22 enters the inducer section 66 in a direction generally parallel to the engine centerline A and is turned by the inducer section 66 radially outwardly through the core airflow passage 80 of the hollow fan blades 28. The airflow is further compressed centrifugally in the hollow fan blades 28 by rotation of the hollow fan blades 28. From the core airflow passage 80, the airflow is turned and diffused axially forward in the engine 10 into the annular combustor 30. The compressed core airflow from the hollow fan blades 28 is mixed with fuel in the annular combustor 30 and ignited to form a high-energy gas stream. The high-energy gas stream is expanded over the multitude of tip turbine blades 34 mounted about the outer periphery of the fan blades 28 to drive the fan-turbine rotor assembly 24, which in turn drives the axial compressor 22 through the gearbox assembly 90. Concurrent therewith, the fan-turbine rotor assembly 24 discharges fan bypass air axially aft to merge with the core airflow from the turbine 32 in an exhaust case 106. A multitude of exit guide vanes 108 are located between the static outer support housing 44 and the nonrotatable static outer support structure 14 to guide the combined airflow out of the engine 10 to provide forward thrust. An exhaust mixer 110 mixes the airflow from the turbine blades 34 with the bypass airflow through the fan blades 28.

Figure 3:
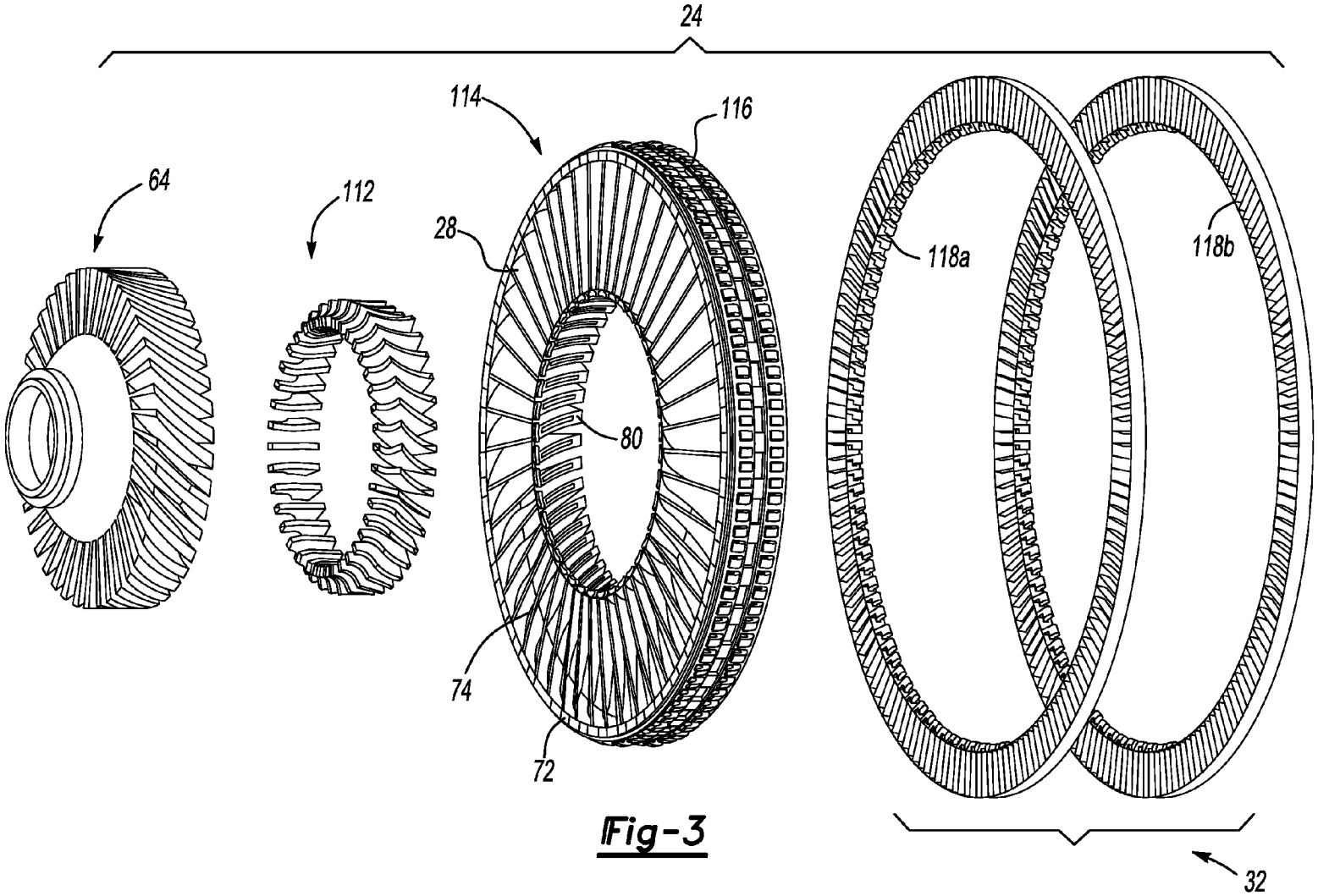
FIG. 3 is an exploded view of a fan-turbine rotor assembly.
Figure 4:
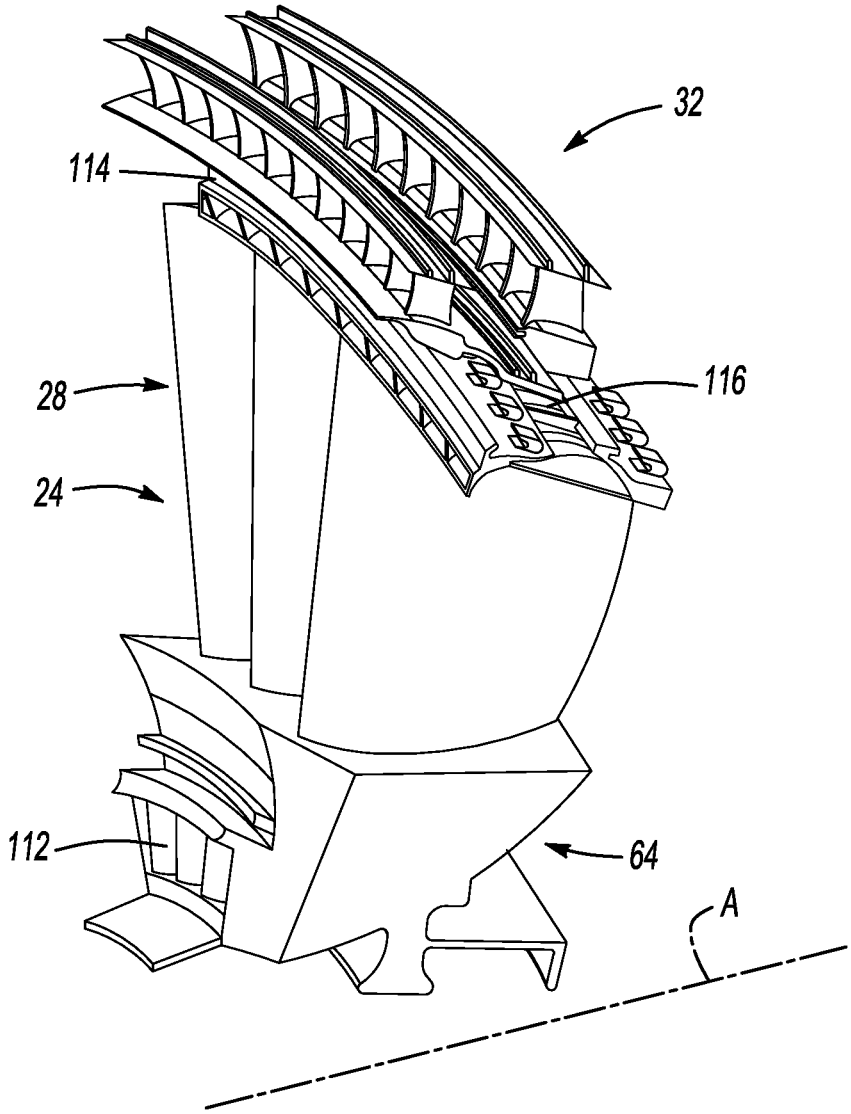
FIG. 4 is an expanded partial perspective view of a fan-turbine rotor assembly.

Referring to FIG. 3, the fan-turbine rotor assembly 24 is illustrated in an exploded view. The fan hub 64 is the primary structural support of the fan-turbine rotor assembly 24 (also illustrated as a partial sectional view in FIG. 4). The fan hub 64 supports an inducer 112, the multitude of fan blades 28, a diffuser 114, and the turbine 32.

Figure 5:
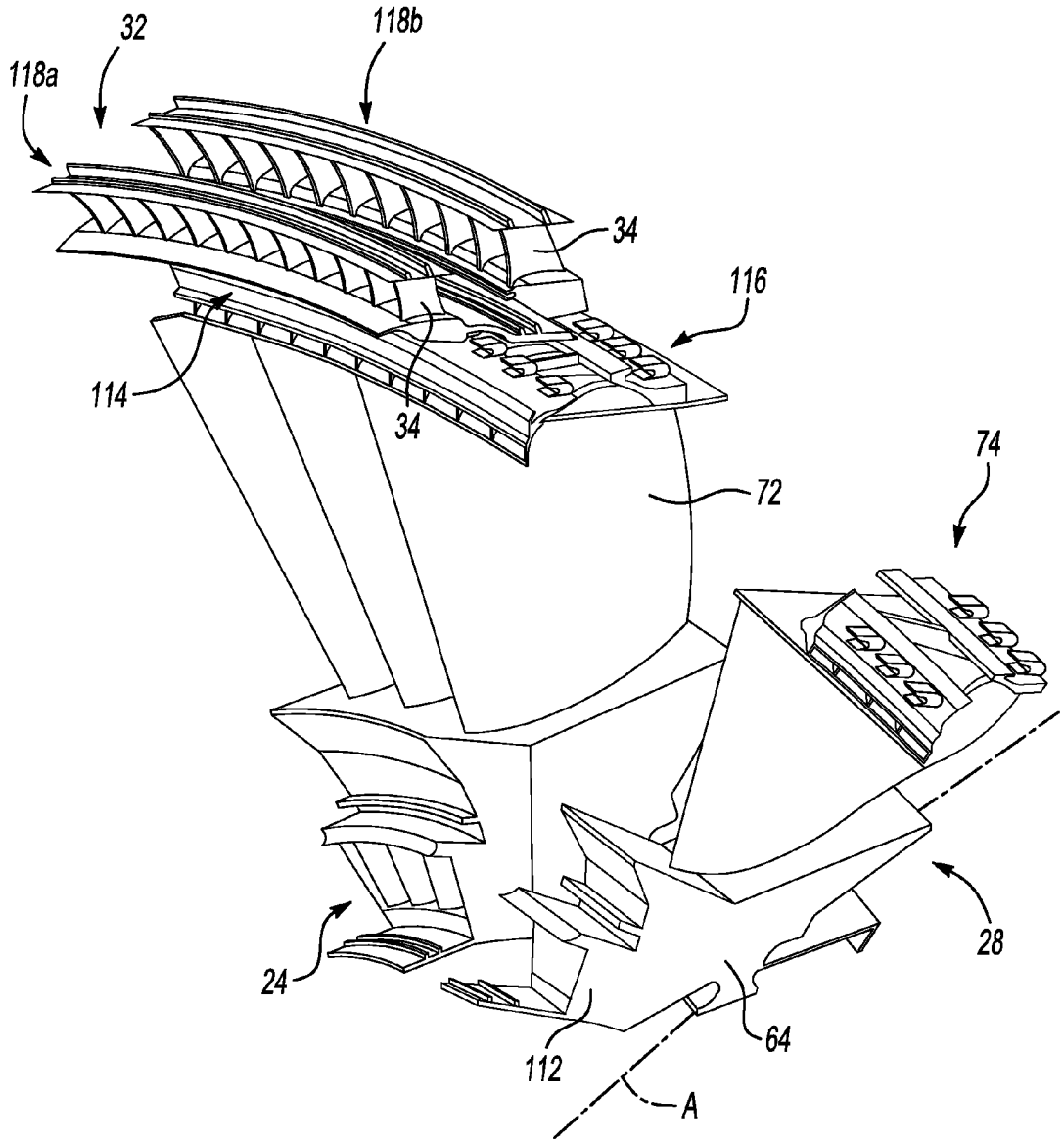
FIG. 5 is an expanded partial perspective view of a fan-turbine rotor assembly illustrating a single fan blade segment.

Referring to FIG. 5, the diffuser 114 is preferably a diffuser surface 116 formed by the multitude of diffuser sections 74 (FIG. 5). The diffuse surface 116 is formed about the outer periphery of the fan blade sections 72 to provide structural support to the outer tips of the fan blade sections 72 and to turn and diffuse the airflow from the radial core airflow passage 80 toward an axial airflow direction. The turbine 32 is mounted to the diffuser surface 116 as one or more turbine ring rotors 118*a*, 118*b*.

Preferably, each fan blade section 72 includes an attached diffuser section 74 such that the diffuser surface 116 is formed when the fan-turbine rotor 24 is assembled. It should be understood, however, that the fan-turbine rotor assembly 24 may be formed in various ways including casting multitude sections as integral components, individually manufacturing and assembling individually manufactured components, and/or other combinations thereof.

Figure 6:
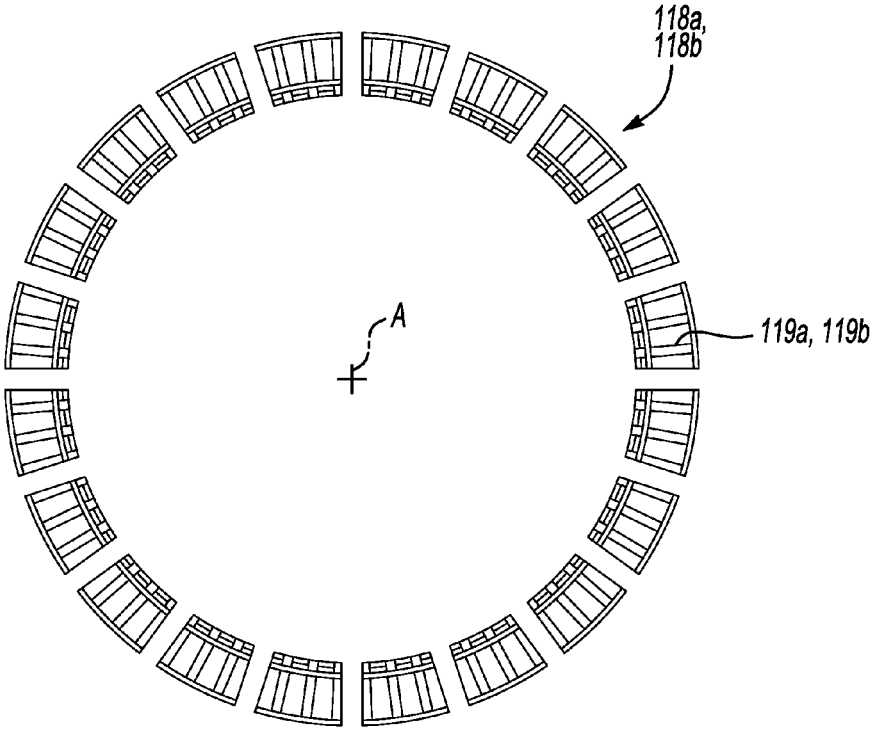
FIG. 6 is an expanded front view of a turbine rotor ring.

Referring to FIG. 6, each turbine ring rotor 118*a*, 118*b* is preferably cast as a single integral annular ring defined about the engine centerline A. By forming the turbine 32 as one or more rings, leakage between adjacent blade platforms is minimized which increases engine efficiency. As discussed herein, turbine rotor ring 118*a* is a first stage of the turbine 32, and turbine ring 118*b* is a second stage of the turbine 32, however, other turbine stages will likewise benefit from the present invention. Furthermore, gas turbine engines other than tip turbine engines will also benefit from the present invention.

Figure 7A:
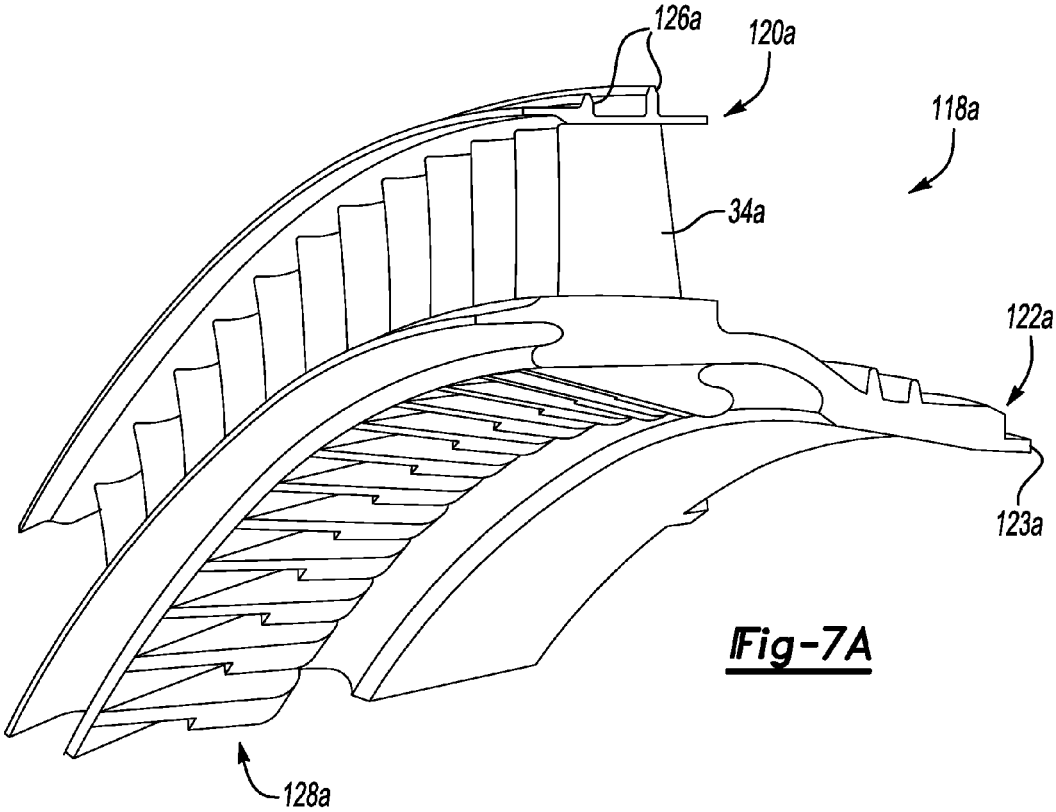
FIG. 7A is an expanded perspective view of a segment of a first stage turbine rotor ring.
Figure 7B:
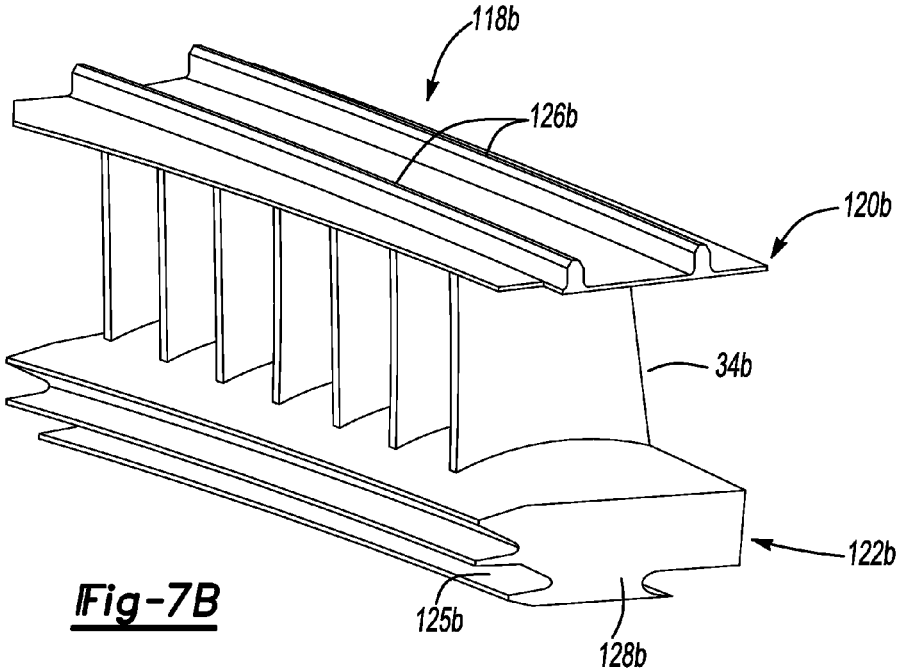
FIG. 7B is an expanded perspective view of a segment of a second stage turbine rotor ring.

Referring to FIGS. 7A and 7B, each turbine ring rotor 118*a*, 118*b* (illustrated as a segment thereof) includes an annular tip shroud 120*a*, 120*b*, an annular base 122*a*, 122*b* and a multitude of turbine blades 34*a*, 34*b* mounted between the annular tip shroud 120*a*, 120*b* and the annular base 122*a*, 122*b*, respectively. The annular tip shroud 120*a*, 120*b* and the annular base 122*a*, 122*b* are generally planar rings defined about the engine centerline A. The annular tip shroud 120*a*, 120*b* and the annular base 122*a*, 122*b* provide support and rigidity to the multitude of turbine blades 34*a*, 34*b*.

Figure 8:
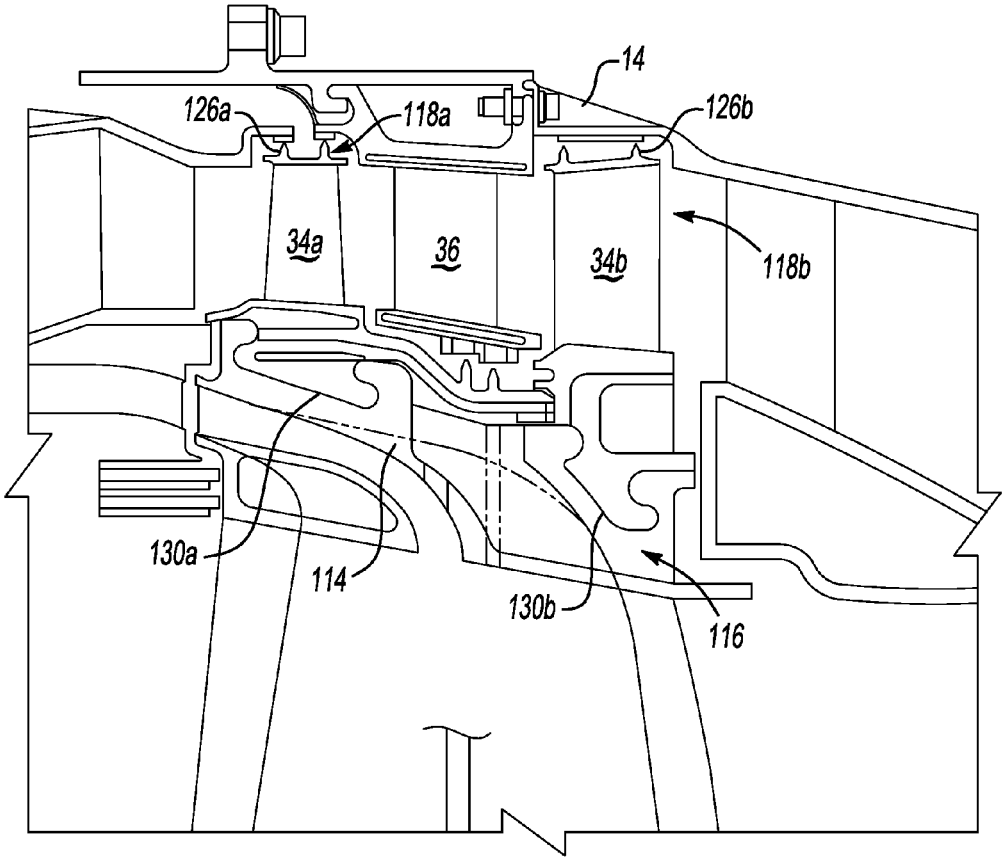
FIG. 8 is a side planar view of a turbine for a tip turbine engine.

The annular tip shroud 120*a*, 120*b* each include a tip seal 126*a*, 126*b* extending therefrom. The tip seal 126*a*, 126*b* preferably extend perpendicular to the annular tip shroud 120*a*, 120*b* to provide a knife edge seal between the turbine ring rotor 118*a*, 118*b* and the nonrotatable static outer support structure 14 (also illustrated in FIG. 8). It should be understood that other seals may alternatively or additionally be utilized.

Figure 9:
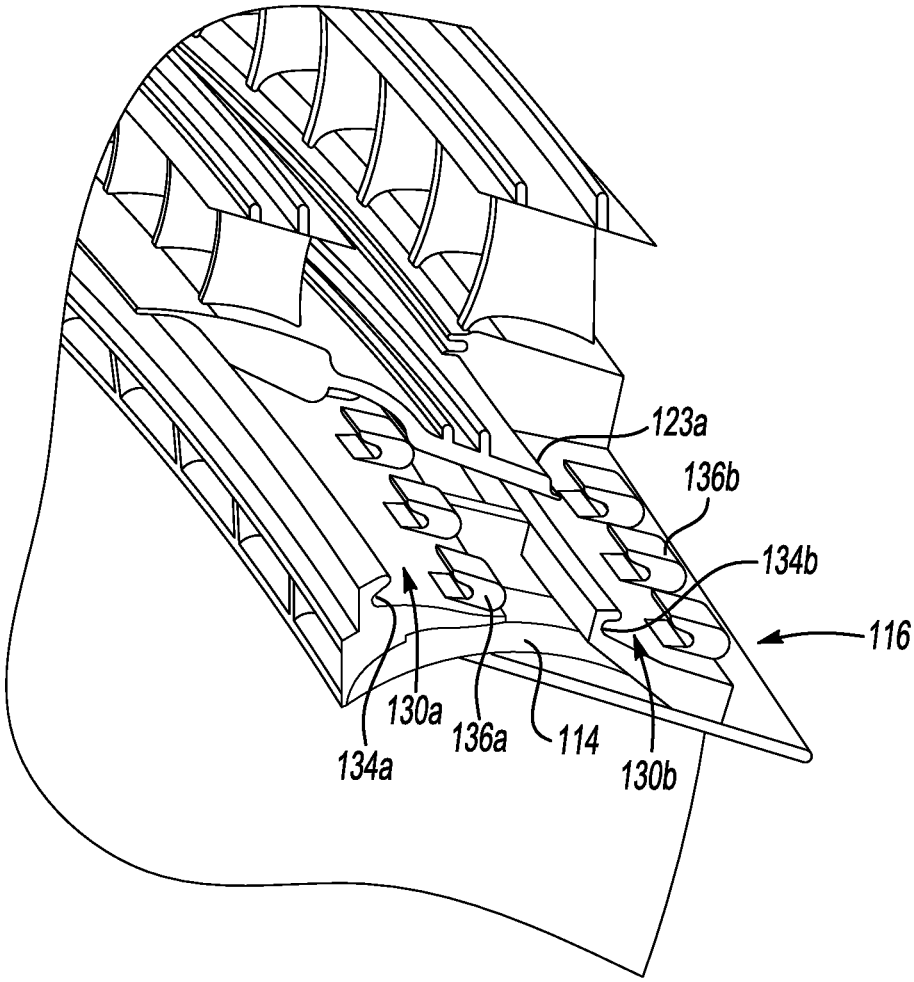
FIG. 9 is an expanded perspective view of a first stage and a second stage turbine rotor ring mounted to a diffuser surface of a fan-turbine rotor assembly.

The annular base 122*a*, 122*b* includes attachment lugs 128*a*, 128*b*. The attachment lugs 128*a*, 128*b* are preferably segmented to provide installation by axial mounting and radial engagement of the turbine ring rotor 118*a*, 118*b* to the diffuser surface 116 as will be further described. The attachment lugs 128*a*, 128*b* preferably engage a segmented attachment slot 130*a*, 130*b* formed in the diffuser surface 116 in a dovetail-type, bulb-type, or fir tree-type engagement (FIG. 9). The segmented attachment slots 130*a*, 130*b* preferably include a continuous forward slot surface 134*a*, 134*b* and a segmented aft slot surface 136*a*, 136*b* (FIG. 9).

The annular base 122*a* preferably provides an extended axial stepped ledge 123*a* which engages a seal surface 125*b* which extends from the annular base 122*b*. That is, annular bases 122*a*, 122*b* provide cooperating surfaces to seal an outer surface of the diffuser surface 116 (FIG. 9).

Figure 10A:
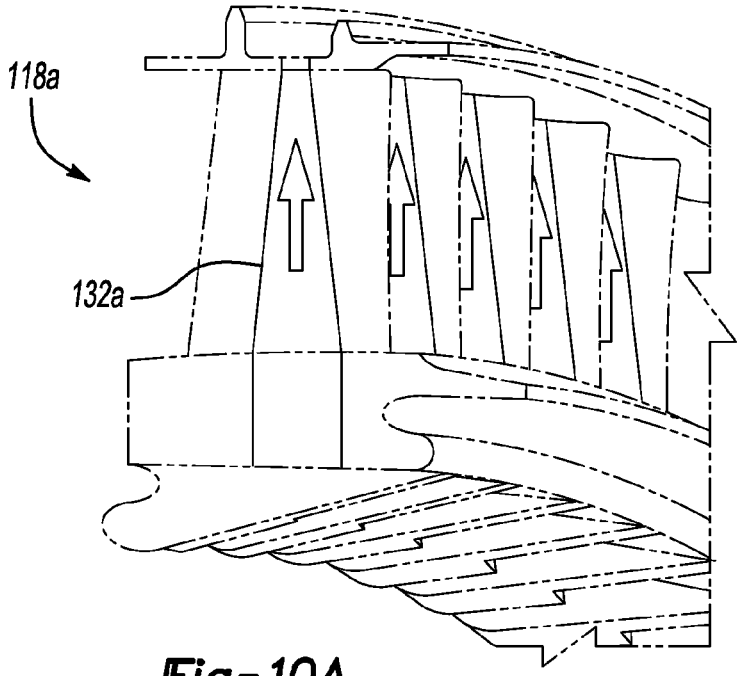
FIG. 10A is an expanded perspective view of a segment of a second stage turbine rotor ring illustrating an airflow passage through a turbine blade.
Figure 10B:
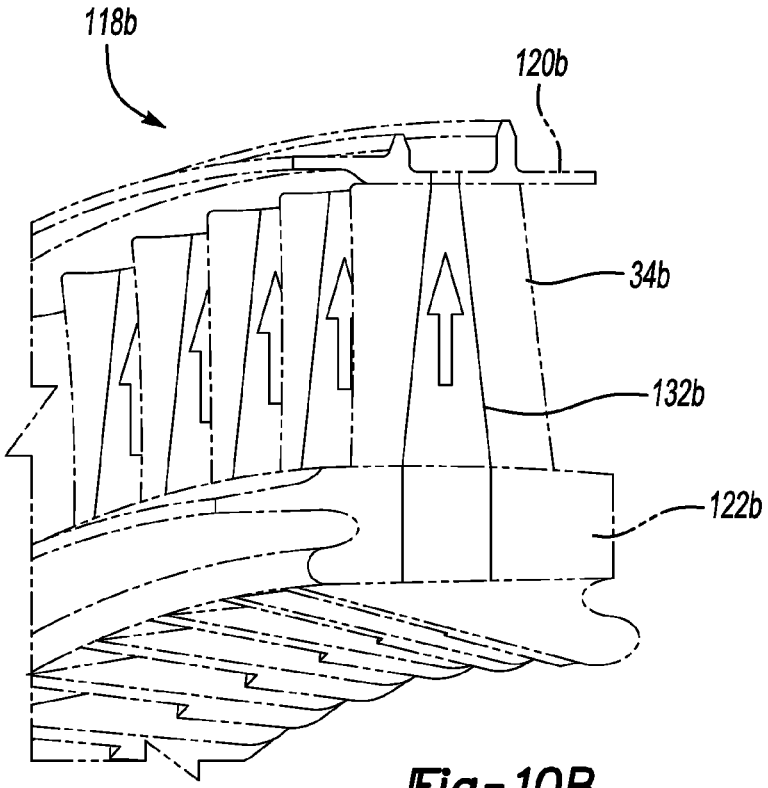
FIG. 10B is an expanded perspective view of a segment of a second stage turbine rotor ring illustrating an airflow passage through a turbine blade.

Referring to FIGS. 10A and 10B, each of the multitude of turbine blades 34*a*, 34*b* defines a turbine blade passage (illustrated by arrows 130*a*, 130*b*) therethrough. Each of the turbine blade passages 132*a*, 132*b* extend through the annular tip shroud 120*a*, 120*b* and the annular base 122*a*, 122*b* respectively. The turbine blade passages 132*a*, 132*b* bleed air from the diffuser to provide for regenerative cooling (FIG. 11).

Figure 11:
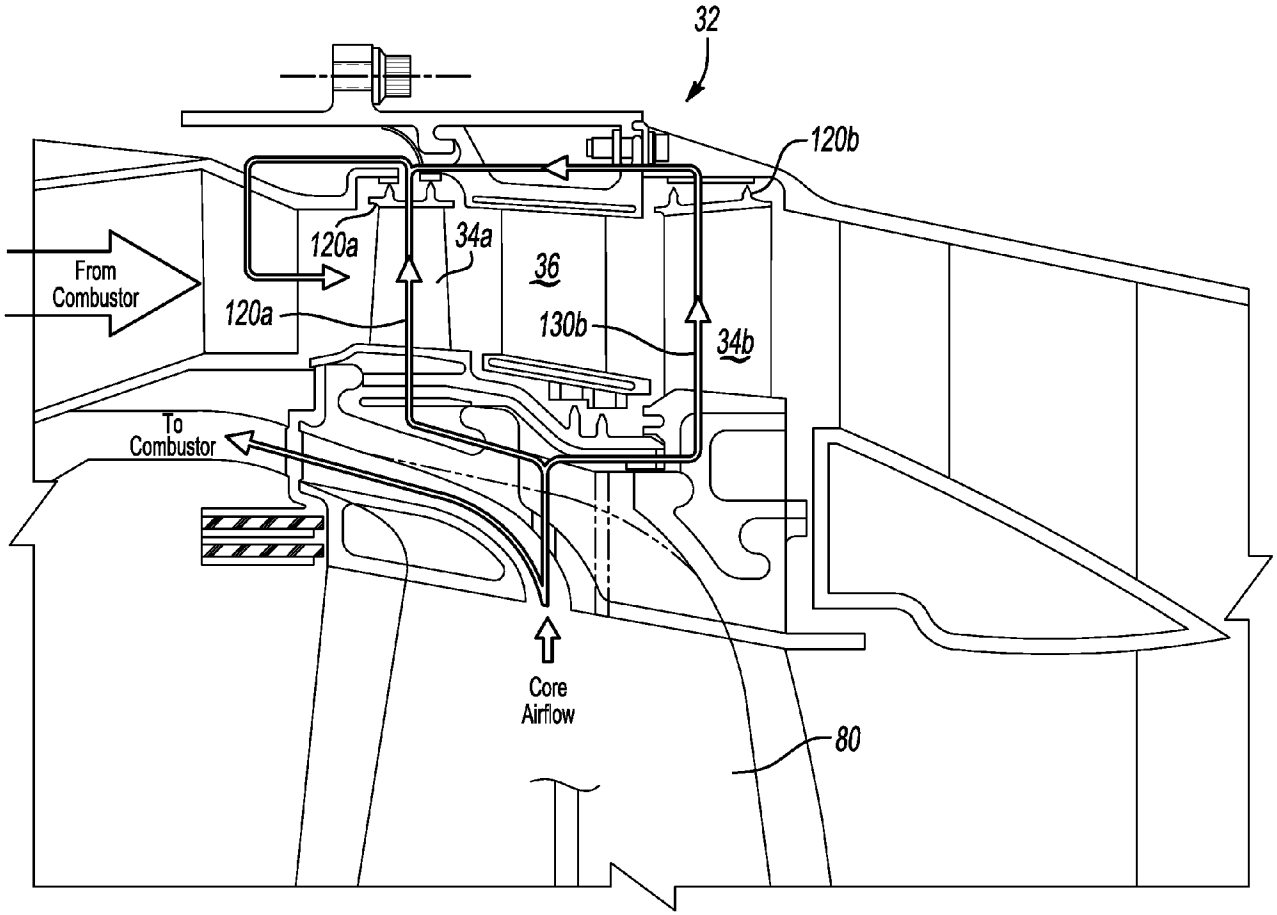
FIG. 11 is a side sectional view of a turbine for a tip turbine engine illustrating a regenerative airflow paths through the turbine.

Referring to FIG. 11, the regenerative cooling airflow exits through the annular tip shroud 120*a*, 120*b* to receive thermal energy from the turbine blades 34*a*, 34*b*. The regenerative cooling airflow also increases the centrifugal compression within the turbine 32 while transferring the increased temperature cooling airflow into the annular combustor to increase the efficiency thereof through regeneration. It should be understood that various regenerative cooling flow paths may be utilized with the present invention.

Figure 12A:
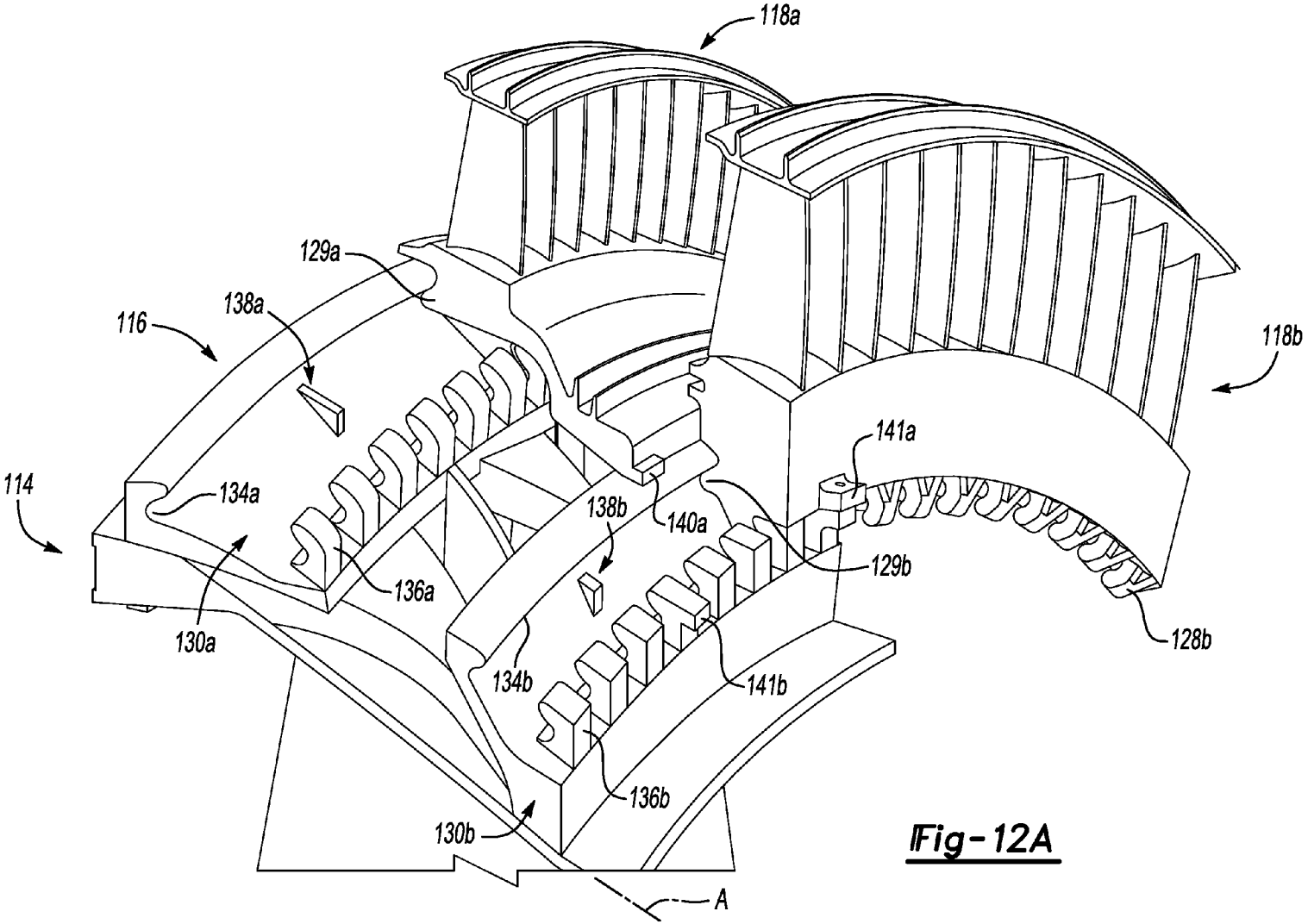
FIG. 12A is an expanded perspective view of a first stage and a second stage turbine rotor ring in a first mounting position relative to a diffuser surface of a fan-turbine rotor assembly.

Referring to FIG. 12A, assembly of the turbine ring rotors 118*a*, 118*b* to the diffuser surface 116, begins with the first stage turbine ring rotor 118*a* which is first axially mounted from the rear of the diffuser surface 116. The forward attachment lug engagement surface 129*a* is engaged with the continuous forward slot engagement surface 134*a* by passing the attachment lugs 128*a* through the segmented aft slot surface 136*a*. That is, the attachment lugs 128*a* are aligned to slide through the lugs of the segmented aft slot surface 136*a*. Next, the second stage turbine ring rotor 118*b* is axially mounted from the rear of the diffuser surface 116. The forward attachment lug engagement surface 129*b* is engaged with the continuous forward slot engagement surface 134*b* by passing the attachment lugs 128*b* through the segmented aft slot surface 136*b*. That is, the attachment lugs 128*b* are aligned to slide between the lugs of the segmented aft slot surface 136*b*.

Figure 12B:
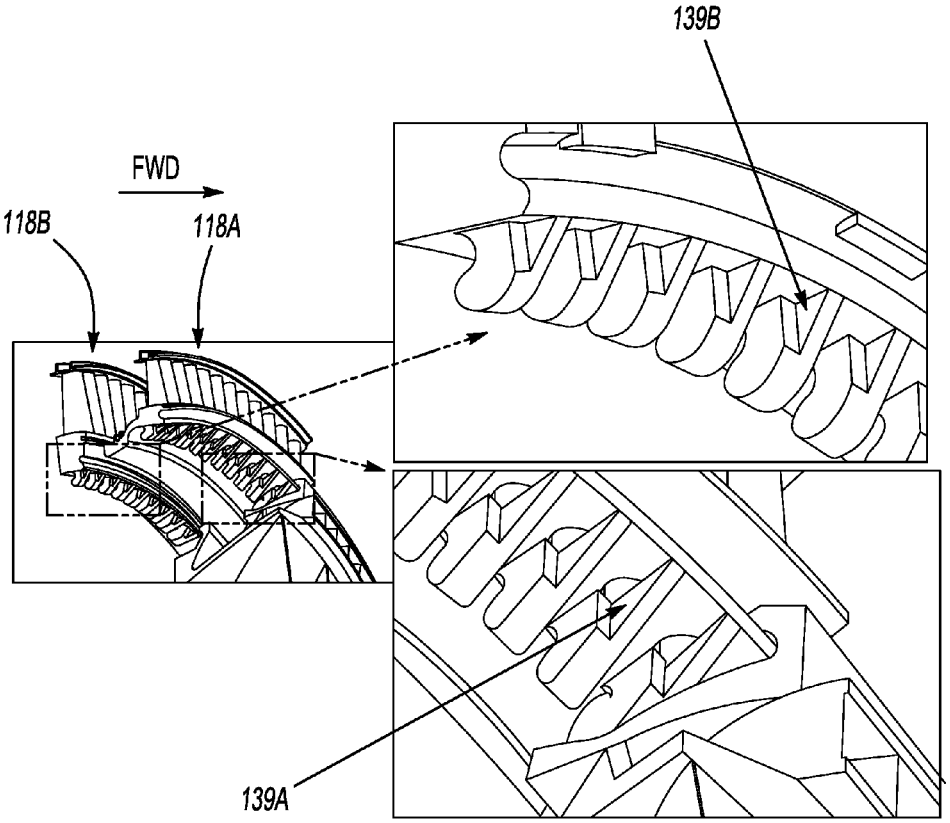
FIG. 12B is an expanded perspective view of a first stage and a second stage turbine rotor ring illustrating turbine torque load surface on each turbine rotor ring.

The extended axial stepped ledge 123*a* of the arcuate base 122*a* receives the seal surface 125*b* which extends from the arcuate base 122*b*. The second stage turbine ring rotor 118*b* rotationally locks with the first stage turbine ring rotor 118*a* through engagement between anti-backout tabs 140*a* and anti-backout slots 140*b* (also illustrated in FIG. 12D).

The turbine ring rotors 118*a*, 118*b* are then rotated as a unit so that a torque load surface 139*a*, 139*b* (FIGS. 12B-12C) contacts a radial stop 138*a*, 138*b* to radially locate the attachment lugs 128*a*, 128*b* in engagement with the lugs of the segmented aft slot surface 136*a*, 136*b* of the segmented attachment slots 130*a*, 130*b*. Preferably, the turbine ring rotors 118*a*, 118*b* are rotated together toward the radial stops 138*a*, 138*b* in a direction which will maintain the turbine ring rotors 118*a*, 118*b* against the radial stops 138*a*, 138*b* during operation. It should be understood that a multitude of torque load surface 139*a*, 139*b* and radial stop 138*a*, 138*b* may be located about the periphery of the diffuser surface 116. It should be further understood that other locking arrangements may also be utilized.

Figure 12C:
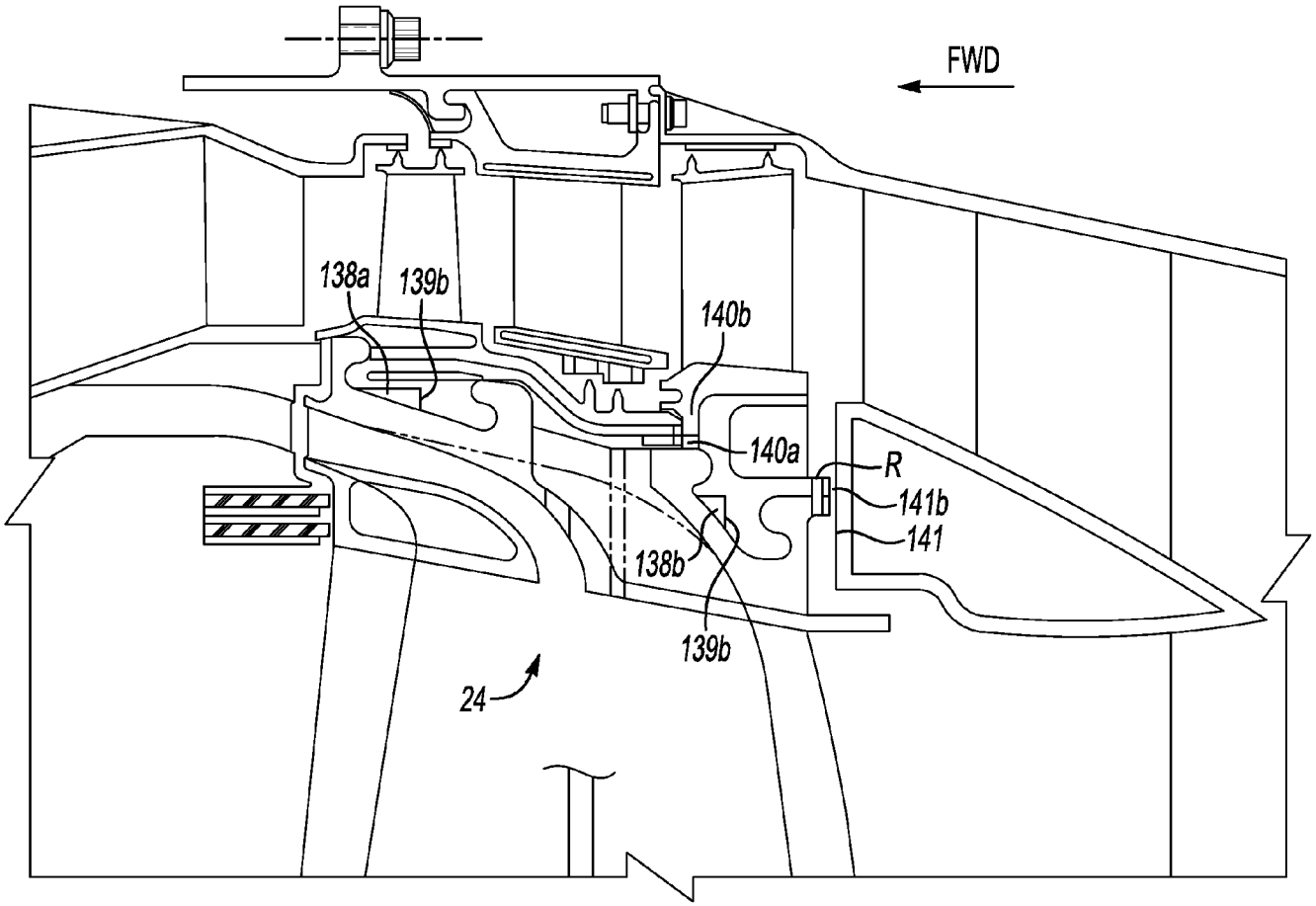
FIG. 12C is a side sectional view of a first stage and a second stage turbine rotor ring illustrating the interaction of the turbine torque load surfaces and adjacent stops.
Figure 12D:
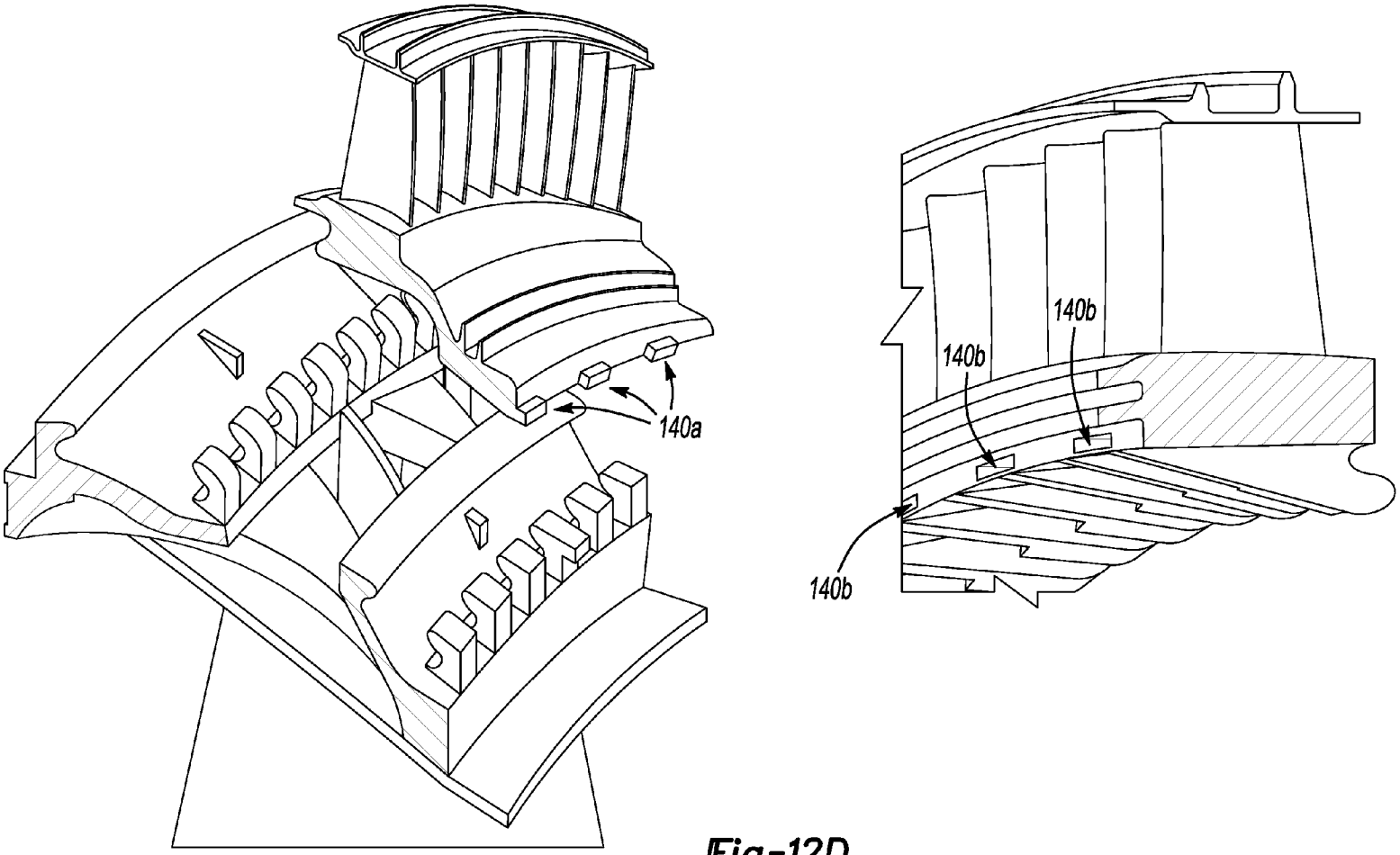
FIG. 12D is an expanded perspective view of a first stage and a second stage turbine rotor ring illustrating the anti-back out tabs and anti-back out slots to lock the first stage and a second stage turbine rotor ring.

Once the turbine ring rotors 118*a*, 118*b* are mounted about the diffuser surface 116, a second stage turbine ring anti-backout retainer tab 141*a* which extends from the second stage turbine ring rotor 118*b* is aligned with an associated anti-backout retainer tab 141*b* which extends from a lug of the segmented aft slot surface 136*b*. The turbine ring anti-backout retainer tabs 141*a* and the anti-backout retainer tabs 141*b* are locked together through a retainer R such as screws, peening, locking wires, pins, keys, and/or plates as generally known. The turbine ring rotors 118*a*, 118*b* are thereby locked radially together and mounted to the fan-turbine rotor assembly 24 (FIG. 12C).

It should be understood that relative positional terms such as "forward," "aft," "upper," "lower," "above," "below," and the like are with reference to the normal operational attitude of the vehicle and should not be considered otherwise limiting.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A turbine ring rotor comprising:

first and second annular tip shrouds defined about an axis;

first and second annular bases defined about said axis;

a plurality of first turbine blades mounted between said first annular tip shroud and said first annular base;

a plurality of second turbine blades mounted between said second annular tip shroud and said second annular base, said second turbine blades spaced, relative to the axis, from said first turbine blades; and wherein each of said first and second of turbine blades defines a turbine blade passage therethrough, each of said turbine blade passages extending through a respective one of said first and second annular tip shrouds and a respective one of said first and second annular bases, said turbine blade passages arranged such that fluid flowing through said turbine blade passages is later expanded over said first turbine blades.

2. The turbine ring rotor as recited in claim 1, further comprising a base seal extending from said second annular base.

3. The turbine ring rotor as recited in claim 2, wherein said first annular base includes an extended axial stepped ledge.

4. The turbine ring rotor as recited in claim 1, wherein each of said first turbine blades, said first annular tip shroud and said first annular base are a single casting.

5. The turbine ring rotor as recited in claim 1, wherein each of said second turbine blades, said second annular tip shroud and said second annular base are a single casting.

6. The turbine ring rotor as recited in claim 1, further including a segmented attachment lug, said segmented attachment lug being segmented into first and second attachment lugs associated with a respective one of the first and second annular bases.

7. The turbine ring rotor as recited in claim 1, wherein first and second of turbine blades rotate about said axis.

8. The turbine ring rotor as recited in claim 7, further including a plurality of stators positioned axially between said first and second turbine blades.

9. The turbine ring rotor as recited in claim 8, wherein said stators are rotationally fixed relative to said axis.

10. The turbine ring rotor as recited in claim 1, further including a first tip seal radially outward of said first annular tip shroud, and further including a second tip seal radially outward of said second annular tip shroud.

11. The turbine ring rotor as recited in claim 10, wherein said turbine passages direct a core airflow radially through said first and second tip seals.

12. The turbine ring rotor as recited in claim 11, wherein said first and second tip seals extend from said first and second annular tip shrouds, respectively, towards a static outer support structure.

13. The turbine ring rotor as recited in claim 1, wherein said fluid flowing through said turbine blade passages is later expanded over said first turbine blades and said second turbine blades.

14. A turbine ring rotor comprising:

first and second annular tip shrouds defined about an axis;

first and second annular bases defined about said axis;

a plurality of first turbine blades mounted between said first annular tip shroud and said first annular base;

a plurality of second turbine blades mounted between said second annular tip shroud and said second annular base, said second turbine blades spaced, relative to the axis, from said first turbine blades;

wherein each of said first and second of turbine blades defines a turbine blade passage therethrough, each of said turbine blade passages extending through a respective one of said first and second annular tip shrouds and a respective one of said first and second annular bases;

a segmented attachment lug, said segmented attachment lug being segmented into first and second attachment lugs associated with a respective one of the first and second annular bases; and a plurality of slot surfaces formed in a diffuser surface, said diffuser surface located radially inward of said first and second attachment lugs, said first and second attachment lugs aligned with said slot surfaces.

15. The turbine ring rotor as recited in claim 14, wherein said plurality of slot surfaces provide one of a dovetail-type, a bulb-type, and a fir tree-type engagement.

16. A gas turbine engine, comprising:

a plurality of fan blades configured to rotate about an axis;

first and second annular tip shrouds defined about said axis;

first and second annular bases defined about said axis;

a plurality of first turbine blades mounted between said first annular tip shroud and said first annular base, said first turbine blades mounted radially outward of said fan blades;

a plurality of second turbine blades mounted between said second annular tip shroud and said second annular base, said second turbine blades spaced, relative to the axis, from said first turbine blades, said second turbine blades mounted radially outward of said fan blades; and wherein each of said first and second of turbine blades defines a turbine blade passage therethrough, each of said turbine blade passages extending through a respective one of said first and second annular tip shrouds and a respective one of said first and second annular bases.

17. The gas turbine engine as recited in claim 16, wherein said fan blades are hollow and define radial core airflow passages, said radial core airflow passages in fluid communication with said turbine blade passages.

18. The gas turbine engine as recited in claim 17, including a combustor, and wherein fluid passing through said radial core airflow passages and said turbine blade passages is directed to said combustor and is then expanded over said first and second turbine blades.

19. The gas turbine engine as recited in claim 18, wherein said combustor is positioned radially outward of said fan blades. pq,12

* * * * *

UNITED STATES PATENT AND TRADEMARK OFFICE

CERTIFICATE OF CORRECTION

PATENT NO. : 8,672,630 B2
APPLICATION NO. : 13/350937
DATED : March 18, 2014
INVENTOR(S) : Sucie et al.

It is certified that error appears in the above-identified patent and that said Letters Patent is hereby corrected as shown below:

In the Claims

In claim 19, column 8, line 47: delete "pq,12"

Signed and Sealed this
Twelfth Day of August, 2014

Michelle K. Lee

Michelle K. Lee
*Deputy Director of the United States Patent and Trademark Office*